US005832883A

United States Patent [19]

Bae

[11] Patent Number: 5,832,883

[45] Date of Patent: Nov. 10, 1998

[54] ELECTROMAGNETICALLY ACTUATED INTAKE OR EXHAUST VALVE FOR AN INTERNAL COMBUSTION ENGINE

[75] Inventor: Duk-Han Bae, Kyunggi-do, Rep. of Korea

[73] Assignee: Hyundai Motor Company, Seoul, Rep. of Korea

[21] Appl. No.: 777,698

[22] Filed: Dec. 20, 1996

[30] Foreign Application Priority Data

Dec. 23, 1995 [KR] Rep. of Korea ..... 1995-55787

[51] Int. Cl.[6] ..... F01L 9/04

[52] U.S. Cl. ..... 123/90.11; 123/90.12

[58] Field of Search ..... 123/90.11, 90.12, 123/90.15, 90.24; 251/129.01, 129.02, 129.05, 129.15, 129.16

[56] References Cited

U.S. PATENT DOCUMENTS

| | | | |
|---|---|---|---|
| 3,209,737 | 10/1965 | Omotehara et al. | 123/90.12 |
| 4,009,694 | 3/1977 | Firey | 123/90.12 |
| 4,515,343 | 5/1985 | Pischinger et al. | 123/90.11 |
| 4,794,890 | 1/1989 | Richeson, Jr. | 123/90.11 |
| 4,841,923 | 6/1989 | Buchl | 123/90.11 |
| 4,846,120 | 7/1989 | Buchl | 123/90.11 |
| 5,190,013 | 3/1993 | Dozier | 123/90.11 |
| 5,193,495 | 3/1993 | Wood, III | 123/90.12 |
| 5,199,392 | 4/1993 | Kreuter et al. | 123/90.11 |
| 5,275,136 | 1/1994 | Schechter et al. | 123/90.12 |
| 5,596,956 | 1/1997 | Ogawa et al. | 123/90.11 |
| 5,606,940 | 3/1997 | Shafer et al. | 123/90.12 |

*Primary Examiner*—Weilun Lo

*Attorney, Agent, or Firm*—Finnegan, Henderson, Farabow, Garrett & Dunner, L.L.P.

[57] ABSTRACT

An intake or exhaust valve for an internal combustion engine includes a valve member having a head and a stem extending from the head, the head of the valve member being capable of forming a seal with a valve seat of the internal combustion engine, an electromagnetic actuator for moving the valve member axially from a closed position wherein the head forms a seal with the valve seat and an open position wherein the head is spaced from the valve seat to permit flow between the head and the valve seat, and an actuator controller for selectively activating the electromagnetic actuator to control movement of the valve member. The intake or exhaust valve includes a dampener for limiting closing speed of the valve member.

12 Claims, 3 Drawing Sheets

ELECTROMAGNETICALLY ACTUATED INTAKE OR EXHAUST VALVE FOR AN INTERNAL COMBUSTION ENGINE

BACKGROUND OF THE INVENTION

1. Field of the Invention

The present invention relates to an intake or exhaust valve for an internal combustion engine. More particularly, the present invention relates to an intake or exhaust valve opening and closing apparatus having an electromagnetic coil to close or open the valve in response to a signal from a controller.

2. Description of Related Art

Generally, an internal combustion engine of an automobile has intake and exhaust valves for controlling intake of an air fuel mixture and exhaust of combustion byproducts, respectively, by opening and closing the intake and exhaust valves.

As shown in FIG. 4, a cylinder head 1' of a conventional engine is provided with an intake or exhaust valve member 2' (hereinafter, simply referred to as "valve member") for closing or opening an intake or exhaust port 3' (hereinafter, simply referred to as "port"), a valve stem guide 4' attached to the cylinder head 1', a valve spring 6' between the cylinder head 1' and a spring supporting plate 5' attached to an upper portion of the valve member 2', a lash adjuster 7' disposed at an upper portion of the valve member 2', and a cam 8' disposed above the lash adjuster 7'. When the cam 8' rotates, the cam 8' contacts the lash adjuster 7' and reciprocates the valve member 2' between a closed position and open position. The valve stem guide 4' guides movement of the valve member 2' and the valve spring 6' biases the valve member 2' toward the cam 8' into the closed position. The lash adjuster 7' automatically adjusts valve clearance.

As the cam 8' rotates to perform an intake or exhaust stroke, the valve member 2' moves to the open position and intake of the air fuel mixture or exhaust of the combustion byproducts takes place through the port 3', while the valve spring 6' is resiliently compressed.

After completing either the intake or exhaust stroke, the cam 8' continues to rotate and performs a compression or ignition stroke, where the cam 8' releases pressure applied to the lash adjuster 7' and allows the valve spring 6' to expand. The valve member 2' ascends, thereby closing the port 3', and at the same time, lifting the lash adjuster 7' to return to an initial position.

Various parts, such as the valve stem guide 4', spring supporting plate 5', valve spring 6', lash adjuster 7', cam 8', and so forth, are required to open or close the valve member 2'. This mechanism reduces efficiency and is complicated. In addition, this conventional structure adds weight to a vehicle and requires a large cylinder head 1'.

FIG. 5 shows valve lift taking place while the cam 8' rotates through different crank angles. In the above-mentioned conventional structure, the outer profile and rotation of the cam 8' determine the timing and duration for the opening and closing of the valve member 2'. Therefore, the valve timing and duration are designed for high engine power at fast rotational speeds. However, at slower rotational speeds of the engine this causes poor fuel economy, reduced performance, increased exhaust gas, and reduced stability at idling.

In light of the foregoing, there is a need in the art for an improved valve.

SUMMARY OF THE INVENTION

Accordingly, the present invention is directed to a valve that substantially obviates one or more of the limitations of the related art. In particular, the present invention is directed to an intake or exhaust valve having an electromagnetic actuator to close or open the intake or exhaust valve in response to a signal from a controller. Preferably, the invention facilitates control of the valve operating timing based on conditions of the engine, thereby providing reduced fuel consumption, improved performance and idling stability, reduction of exhaust gas, and structural simplicity allowing for a smaller cylinder head.

To achieve these and other advantages and in accordance with the purposes of the invention, as embodied and broadly described herein, the invention includes an intake or exhaust valve for an internal combustion engine, comprising a valve member having a head and a stem extending from the head, the head of the valve member being capable of forming a seal with a valve seat of the internal combustion engine, an electromagnetic actuator for moving the valve member axially from a closed position wherein the head forms a seal with the valve seat and an open position wherein the head is spaced from the valve seat to permit flow between the head and the valve seat, and an actuator controller for selectively activating the electromagnetic actuator to control movement of the valve member.

In another aspect, an electronic controller is provided for controlling the actuator controller in response to conditions of the engine.

In a further aspect, a dampener is provided for limiting closing speed of the valve member.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate an embodiment of the invention and, together with the description, serve to explain the principles of the invention. In the drawings.

DETAILED DESCRIPTION OF THE PREFERRED EMBODIMENT

Figure 2:
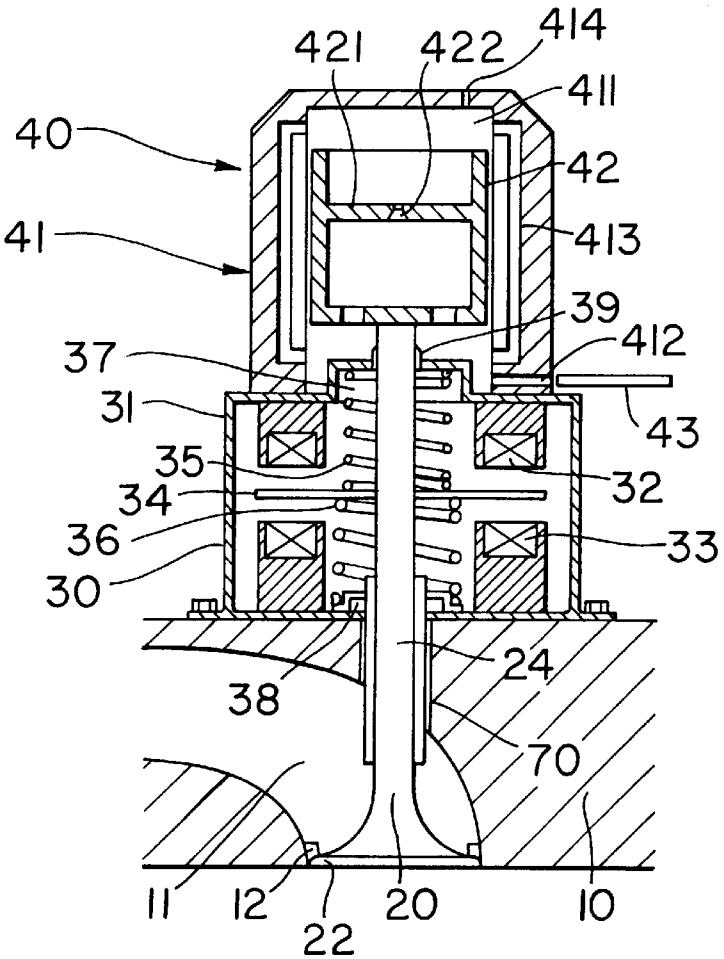
FIG. 2 is a cross-sectional view of a portion of the valve of FIG. 1.

Reference will now be made in detail to the present preferred embodiment of the invention, an example of which is illustrated in the accompanying drawings. Wherever possible, the same reference numbers are used in the drawings and the description to refer to the same or like parts.

Figure 1:
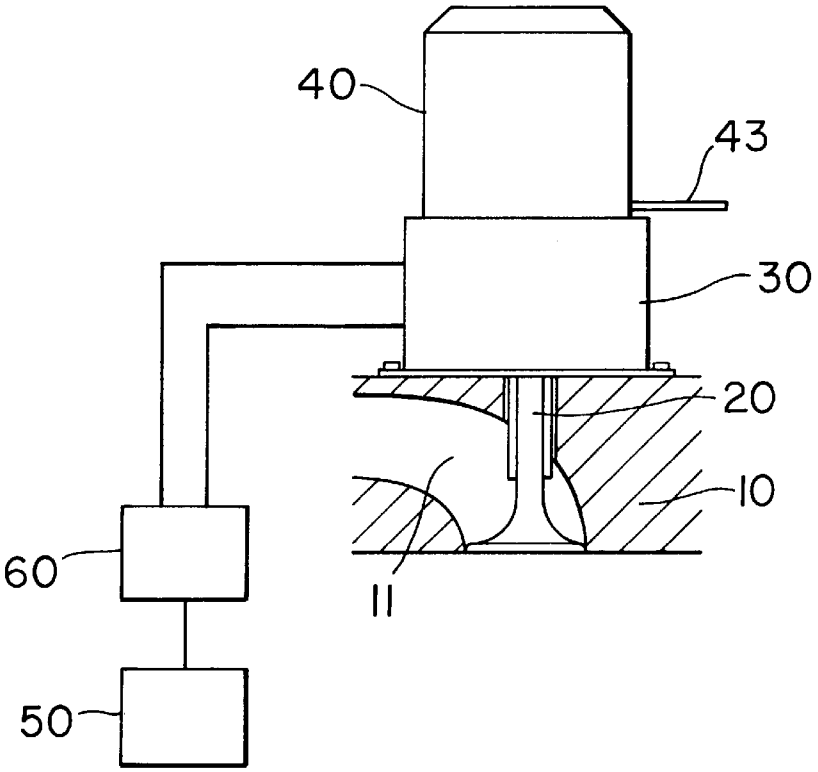
FIG. 1 shows an intake or exhaust valve for an internal combustion engine according to the present invention.

As shown in FIG. 1 and FIG. 2, an intake or exhaust valve for an internal combustion engine includes a valve member 20 for opening or closing an intake or exhaust port 11 (referred to as valve port) of a cylinder head 10, an electromagnetic actuator 30 attached to an upper portion of the cylinder head 10, a dampener 40 attached to the electromagnetic actuator 30, an electronic controller 50 for determining the operational conditions of an engine and controlling the timing of valve closing or opening, and an actuator controller 60 for activating the electromagnetic actuator 30 at proper intervals based on signals from the electronic controller 50.

The electromagnetic actuator 30 electromagnetically moves the valve member 20 in response to electric signals from the actuator controller 60. As described in more detail below, the dampener 40 hydraulically reduces closing speed of the valve member 20 to prevent damage to the valve member 20, which may occur due to impact against the cylinder head 10 during closing of the valve member 20.

As shown in FIG. 2, the valve member 20 includes a head 22 and a stem 24 extending from the head 22. An entrance of the valve port 11 in the cylinder head 10 has a valve seat 12 which comes in contact with the head 22 of the valve member 20 to form a seal when the valve member 20 is closed.

The electromagnetic actuator 30 includes a housing 31 on the cylinder head 10, upper and lower electromagnetic coils 32 and 33 in upper and lower portions of the housing 31, an armature 34 positioned in a middle portion of the housing 31, and upper and lower elastic members 35 and 36 on opposite sides of the armature 34.

The upper and lower electromagnetic coils 32 and 33 each generate magnetic fields in response to signals from the actuator controller 60. The armature 34 is connected to the stem 24 and magnetically attached by the magnetic fields generated by the electromagnetic coils 32 and 33 to open and close the valve member 20. The elastic members 35 and 36 return the armature 34 to a neutral position and create a biasing force for returning the valve member 20 from the open position to the closed position.

The valve stem guide 70 is attached to both the housing 31 and the cylinder head 10. The valve stem guide 70 guides the stem 24 of valve member 20 when the valve member 20 moves upward and downward during valve opening and closing.

An upper spring seat 37 is formed in an upper portion of the housing 31 to support the upper elastic member 35 between the upper spring seat 37 and the armature 34. A lower spring seat 38 is formed in a lower portion of the housing 31 and attached to the valve stem guide 70. The lower spring seat 38 supports the lower elastic member 36 between the lower spring seat 38 and the armature 34. The upper and lower spring seats 37 and 38 prevent fluctuation of the elastic members 35 and 36.

The upper and lower elastic members 35 and 36 are designed so that a biasing force of the lower elastic member 36 is greater than a biasing force of the upper elastic member 35. This biases the valve member 20 toward the closed position and ensures that the head 22 forms a seal with the valve seat 12 in the closed position.

Preferably, the upper and lower elastic members 35 and 36 are springs. However, any component capable of applying a biasing force may be used.

The dampener 40 has a chamber body 41 and a piston 42 slidable in a sealed manner along an inner wall surface of the chamber body 41. The chamber body 41 is attached to an upper surface of the housing 31 of the electromagnetic actuator 30 and includes an interior 411 for containing oil supplied to the chamber body 41 via an opening at a lower portion of the dampener 40 communicating with an oil tube 43 connected to an oil pump (not shown).

The chamber body 41 includes a return oil flow passage 413 extending between upper and lower portions of the chamber body 41 so that the oil in the interior 411 can be circulated. The piston 42 is attached to an upper portion of the stem 24 of valve member 20 and adjusts speed of the valve member 20 during the opening or closing of the valve member 20. As shown in FIG. 2, the piston 42 has wall 421 isolating an upper compartment of the dampener 40 from a lower compartment of the dampener 40. An orifice 422 formed at a central portion of the wall 421 allows restricted flow of the oil between the compartments.

The chamber body 41 also has an air exhausting hole 414 formed in an upper portion thereof, for exhausting air which may be contained in the oil.

An upper portion of the housing 31 includes an oil seal 39 surrounding a portion of the stem 24, for preventing leakage of the oil from the dampener 40 when the stem 24 slides in the seal 39.

The electronic controller 50 determines operating conditions of an internal combustion engine, such as the engine speed, load, etc., and then calculates the proper timing for the closing or opening of the valve member 20.

The actuator controller 60 opens or closes the valve member 20 by supplying electric power to the upper and lower electromagnetic coils 32 and 33 of the electromagnetic actuator 30, respectively, at determined times.

After an engine is started, the actuator controller 60 supplies power from a power source (not shown) to the magnetic actuator 30 in response to valve opening or closing control signals from the electronic controller 50.

If the actuator controller 60 receives an opening signal from the electronic controller 50, electric current is applied to the lower electromagnetic coil 33 of the electromagnetic actuator 30, thus causing the lower electromagnetic coil 33 to produce a magnetic field attracting the armature 34. This lowers the armature 34 toward the lower electromagnetic coil 33 and lowers the valve member 20 to open the valve port 11.

When the armature 34 is moved downward in response to the magnetic field, the lower elastic member 36 resiliently compresses, while the upper elastic member 35 resiliently elongates.

When the valve member 20 descends, the piston 42 in the dampener 40 also descends. The oil contained in the interior 411 of the chamber body 41 is compressed in the lower area of the interior 411 as the piston 42 moves. This oil flows toward the upper side of the chamber body 41 through the oil flow passage 413 and through the orifice 422 in the wall 421.

Therefore, the piston 42 quickly descends to allow for rapid opening of the valve member 20.

When the actuator controller 60 receives a closing signal from the electronic controller 50, electric current is applied to the upper electromagnetic coil 32 of the electromagnetic actuator 30. This causes the upper electromagnetic coil 32 to produce a magnetic field attracting the armature 34, while the lower electromagnetic coil 33 is deactivated. The armature 34 moves toward the upper magnetic coil 32 from the lower magnetic coil 33 so that the valve member 20 rises to close the valve port 11.

When the armature 34 moves upwards due to the magnetic field, the upper elastic member 35 resiliently compresses and the lower elastic member 36 resiliently elongates.

When the valve member 20 rises to the closed position, the piston 42 in the dampener 40 slides upwards. Oil in an upper portion of the interior 411 of the chamber body 41 is compressed and flows toward the lower end of the interior 411 through the oil flow passage 413. The shape of orifice 422 formed in the wall 421 restricts flow through the orifice 422 to dampen upward movement of the piston 42. This dampened movement of the piston 42 allows the valve member 20 to be closed gently, preventing abrupt impact between the head 22 and the valve seat 12 of the cylinder head 10.

The electronic controller 50 determines whether the engine is starting, idling, or operating at a particular speed and load to facilitate timing of the opening and closing of the valve member 20, and send the appropriate control signal to the actuator controller 60 so that the electromagnetic actuator 30 properly opens or closes the valve member 20.

Figure 3A:
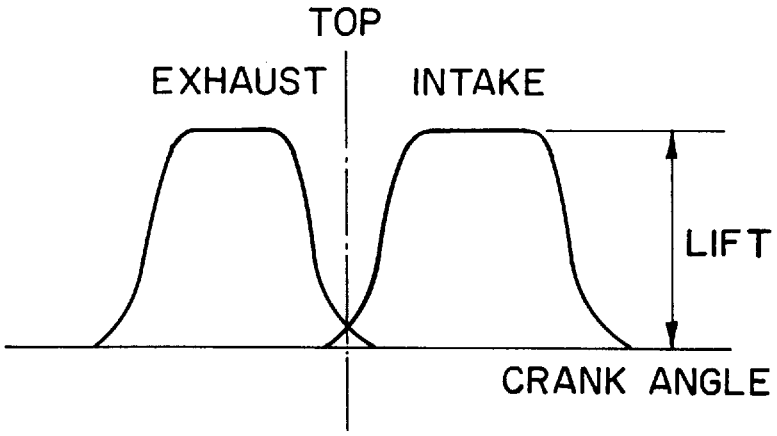
FIGS. 3(A) and (B) are valve timing diagrams showing theoretical opening lift curves of the valve of FIG. 1 at low and high speeds, respectively, according to the present invention.
Figure 3B:
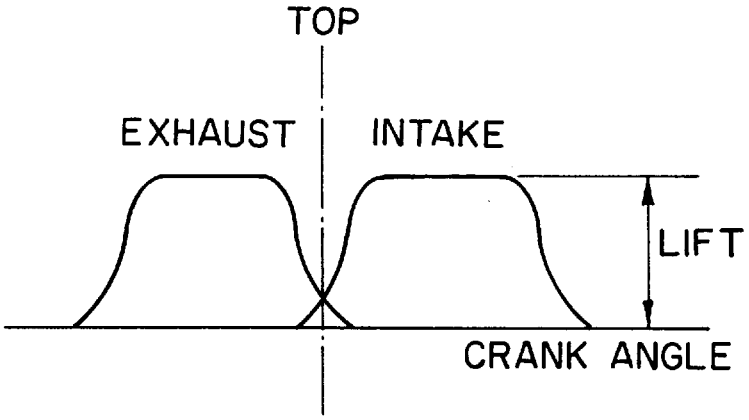
Figure 4:
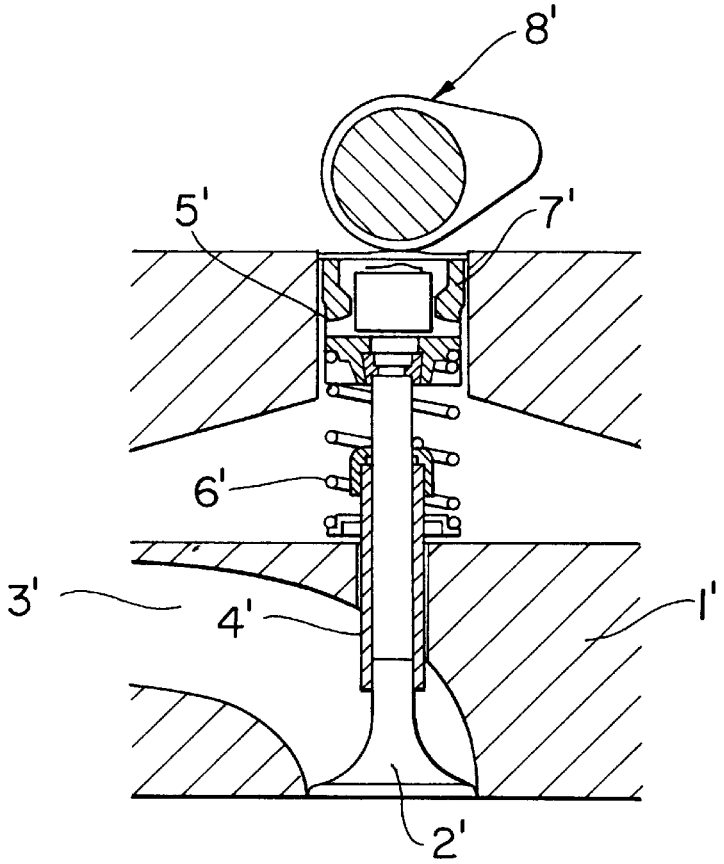
FIG. 4 (PRIOR ART)
FIG. 4 shows a conventional intake or exhaust valve opening/closing apparatus for an internal combustion engine.
Figure 5:
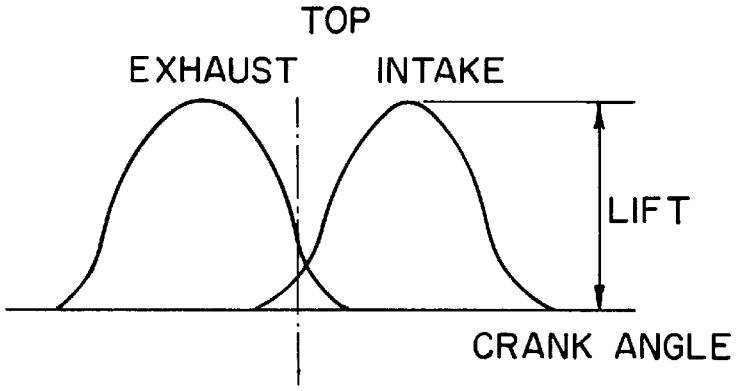
FIG. 5 (PRIOR ART)
FIG. 5 is a valve timing diagram showing an opening lift curve for the conventional valve of FIG. 4.

As shown in FIG. 3(A), when the engine is at low speed, the time duration necessary for opening the valve member 20 and an overlapped time duration can be reduced. As shown in FIG. 3(B), when the engine is at high speed, the time duration necessary for opening the valve member 20 can be maintained satisfactorily, such that performance and power of the engine are improved. In addition, this guarantees stability during idling and reduces both fuel consumption and exhaust gas.

The present invention allows for the elimination of some conventional parts employed for closing or opening of conventional valves. This structural simplicity allows for ease of assembly and the use of a small-sized cylinder head 10, reducing weight of a vehicle significantly, and thereby decreasing fuel consumption.

Since the invention has electromagnetic coils for closing or opening the intake or exhaust valve in response to the signal from the controller, it facilitates control of the timing based upon conditions of the engine, thereby providing reduced fuel consumption, improved performance and idling stability, reduced exhaust gas, and structural simplicity of a smaller cylinder head.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An intake or exhaust valve for an internal combustion engine, comprising:

a valve member having a head and a stem extending from the head, the head of the valve member being capable of forming a seal with a valve seat of the internal combustion engine;

an electromagnetic actuator for moving the valve member axially from a closed position wherein the head forms a seal with the valve seat and an open position wherein the head is spaced from the valve seat to permit flow between the head and the valve seat;

an actuator controller for selectively activating the electromagnetic actuator to control movement of the valve member; and a dampener for limiting closing speed of the valve member, the dampener including a body forming a chamber, the chamber being in flow communication with an oil supply and being filled with oil, and a piston connected to the stem of the valve member, the piston being slidable in the chamber and having an orifice permitting limited flow of the oil through the piston when the piston slides in the chamber.

2. The valve of claim 1, further comprising an electronic controller for controlling the actuator controller in response to conditions of the engine.

3. The valve of claim 1, wherein the electromagnetic actuator includes an armature connected to the stem of the valve member and at least one electromagnetic coil for moving the armature in response to an electric signal from the actuator controller.

4. The valve of claim 3, wherein the electromagnetic actuator includes a pair of electromagnetic coils, the armature being between the electromagnetic coils.

5. The valve of claim 1, wherein the electromagnetic actuator includes a first spring biasing the valve member toward the closed position and a second spring biasing the valve member toward the open position, a biasing force of the first spring being greater than a biasing force of the second spring to urge the valve member toward the closed position.

6. The valve of claim 5, wherein the electromagnetic actuator includes a housing around a portion of the valve stem, the housing having a first spring seat supporting the first spring and a second spring seat supporting the second spring.

7. The valve of claim 6, further comprising a valve stem guide connected to the first spring seat, the valve stem guide guiding the valve member during movement between the closed position and the open position.

8. The valve of claim 5, wherein the electromagnetic actuator includes an armature connected to the stem between the first spring and the second spring and at least one electromagnetic coil for moving the armature in response to an input electric signal.

9. The valve of claim 1, wherein the stem is slidable in a seal at an end of the chamber.

10. The valve of claim 1, wherein the body includes an air vent for venting air from the chamber.

11. The valve of claim 1, wherein the orifice in the piston is shaped to restrict flow of oil through the piston when the valve member moves to the closed position.

12. The valve of claim 1, wherein the body includes at least one passage permitting limited flow of oil between opposite ends of the chamber when the piston slides in the chamber.

* * * * *